US006848950B2

(12) United States Patent
Allison et al.

(10) Patent No.: US 6,848,950 B2
(45) Date of Patent: Feb. 1, 2005

(54) MULTI-INTERFACE POWER CONTACT AND ELECTRICAL CONNECTOR INCLUDING SAME

(75) Inventors: Jeffrey W. Allison, Etters, PA (US); Matthew E. Mostoller, Hummelstown, PA (US); Brian M. Rohrbaugh, Glen Rock, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/444,846

(22) Filed: May 23, 2003

(65) Prior Publication Data

US 2004/0235357 A1 Nov. 25, 2004

(51) Int. Cl.[7] ..... H01R 13/10

(52) U.S. Cl. ..... 439/682; 439/907

(58) Field of Search ..... 439/682, 79, 78, 439/660, 907, 507, 510–512, 825, 947

(56) References Cited

U.S. PATENT DOCUMENTS

| | | | | |
|---|---|---|---|---|
| 3,193,787 A | * | 7/1965 | McGhee | 439/62 |
| 3,497,850 A | | 2/1970 | Gall, Sr. | 337/197 |
| 3,596,235 A | * | 7/1971 | Teurlings | 439/748 |
| 3,622,950 A | * | 11/1971 | Millinger | 439/264 |
| 3,750,092 A | | 7/1973 | Bury | 339/192 RL |
| 3,789,348 A | | 1/1974 | Lenaerts et al. | 339/198 R |
| 3,910,671 A | | 10/1975 | Townsend | 339/97 R |
| 3,944,312 A | | 3/1976 | Koenig | 339/59 R |
| 4,005,923 A | | 2/1977 | Davis, Jr. | 339/157 |
| 4,073,564 A | | 2/1978 | Davis, Jr. | 339/157 |
| 4,227,762 A | | 10/1980 | Scheiner | 339/91 R |
| 4,322,120 A | * | 3/1982 | Rilling | 439/631 |
| 4,500,160 A | | 2/1985 | Bertsch | 339/166 |
| 4,626,637 A | | 12/1986 | Olsson et al. | 200/284 |
| 4,659,158 A | | 4/1987 | Sakamoto et al. | 339/19 |
| 4,669,801 A | | 6/1987 | Worth | 439/404 |
| 4,685,886 A | | 8/1987 | Denlinger et al. | 439/55 |
| 4,709,976 A | | 12/1987 | Nakama et al. | 439/350 |
| 4,780,088 A | | 10/1988 | Means | 439/107 |
| 4,790,763 A | | 12/1988 | Weber et al. | 439/65 |
| 4,790,764 A | | 12/1988 | Kawaguchi et al. | 439/78 |

(List continued on next page.)

FOREIGN PATENT DOCUMENTS

| | | |
|---|---|---|
| DE | 23 50 834 | 4/1975 |
| DE | 34 41 416 A1 | 5/1986 |
| DE | 40 01 104 A1 | 7/1991 |
| EP | 0 465 013 | 1/1992 |
| EP | 0 724 313 | 7/1996 |
| EP | 0 951 102 A2 | 10/1999 |
| FR | 2 699 744 | 6/1994 |
| GB | 2 168 550 | 6/1986 |
| JP | 09 055 245 | 2/1997 |

OTHER PUBLICATIONS

U.S. Appl. No. 10/352,584.*

FCI, "PwrBlade® Power Distribution Connector System," 2003, www.fciconnect.com, 2 pages.

FCI, "PwrBlade® Power Distribution Connector System," *Technology Innovation Service,* 2003, 2–3.

FCI, "PwrBlade™, new Power Distribution connector for electronic applications," *Product News,* 2003, www.fciconnect.com, 1 page.

FCI, "Act Connectors in action," *Panorama,* 2003, 1 page.

*Primary Examiner*—Tho D. Ta
(74) *Attorney, Agent, or Firm*—Woodcock Washburn LLP

(57) ABSTRACT

An electrical connector is provided, including an insulative housing and one or more power contacts disposed in the insulative housing. Each of the power contacts has a first electrical interface portion for engaging a contact associated with a mating electrical connector, a second electrical interface portion for engaging a printed circuit board, and a third electrical interface portion for engaging a cable plug connector.

14 Claims, 5 Drawing Sheets

U.S. PATENT DOCUMENTS 4,820,169 A 4/1989 Weber et al. ..... 439/65
4,820,175 A 4/1989 Hasegawa et al. ..... 439/98
4,838,809 A 6/1989 Mouissie ..... 439/155
4,845,592 A 7/1989 Himes, Jr. et al. ..... 361/407
4,875,865 A 10/1989 Demler, Jr. et al. ..... 439/101
4,881,905 A 11/1989 Demler, Jr. et al. ..... 439/79
4,900,271 A 2/1990 Colleran et al. ..... 439/595
4,917,625 A 4/1990 Haile ..... 439/358
4,941,830 A 7/1990 Tkazyik et al. ..... 439/59
4,950,186 A 8/1990 Kaley et al. ..... 439/882
4,954,090 A 9/1990 Shimochi ..... 439/76
4,968,263 A 11/1990 Silbernagel et al. ..... 439/246
5,046,960 A 9/1991 Fedder ..... 439/108
5,108,301 A 4/1992 Torok ..... 439/263
5,139,426 A 8/1992 Barkus et al. ..... 439/65
5,152,700 A 10/1992 Bogursky et al. ..... 439/733
5,158,471 A 10/1992 Fedder et al. ..... 439/80
5,207,591 A 5/1993 Ozaki et al. ..... 439/212
5,281,168 A 1/1994 Krehbiel et al. ..... 435/595
5,295,843 A 3/1994 Davis et al. ..... 439/108
5,358,422 A 10/1994 Schaffer et al. ..... 439/346
5,362,249 A 11/1994 Carter ..... 439/357
5,376,012 A 12/1994 Clark ..... 439/80
5,403,206 A 4/1995 McNamara et al. ..... 439/608
5,549,480 A * 8/1996 Cheng ..... 439/79
5,582,519 A 12/1996 Buchter ..... 439/101
5,590,463 A 1/1997 Feldman et al. ..... 29/844
5,618,187 A 4/1997 Goto ..... 439/79
5,622,511 A 4/1997 Jarrett ..... 439/248
5,643,013 A 7/1997 Weidler et al. ..... 439/660
5,667,392 A 9/1997 Kocher et al. ..... 439/79
5,716,234 A 2/1998 Phillips ..... 439/595
5,785,557 A 7/1998 Davis ..... 439/660
5,865,651 A 2/1999 Dague et al. ..... 439/680
5,904,594 A 5/1999 Longueville et al. ..... 439/608
5,924,899 A 7/1999 Paagman ..... 439/701
5,937,140 A 8/1999 Leonard et al. ..... 392/392
6,027,360 A 2/2000 Jenkins ..... 439/364
6,062,911 A 5/2000 Davis et al. ..... 439/630
6,178,106 B1 1/2001 Umemoto et al. ..... 363/146
6,190,215 B1 2/2001 Pendleton et al. ..... 439/853
6,319,075 B1 * 11/2001 Clark et al. ..... 439/825
6,358,094 B1 3/2002 Belopolsky et al. ..... 439/637
6,394,818 B1 5/2002 Smalley, Jr. ..... 439/79
6,402,566 B1 6/2002 Middlehurst et al. .... 439/699.1
6,431,886 B1 * 8/2002 Ramey et al. ..... 439/101
6,471,523 B1 * 10/2002 Shuey ..... 439/63

* cited by examiner 30
31
32
33
33
34
34
35
36
36
37
39
40
41
42

130
131
132
134
135
136
136
137
137
138
140
141
142

60
61
62
63
63
65
66
66
67

MULTI-INTERFACE POWER CONTACT AND ELECTRICAL CONNECTOR INCLUDING SAME

FIELD OF THE INVENTION

The present invention relates to contacts and connectors for transmitting electrical power.

BACKGROUND OF THE INVENTION

Power contacts known in the art include features and configurations that provide either a board-to-board interface or a board-to-cable interface when employed in electrical connectors. By way of example, power contacts providing a board-to-board interface may employ a body member (e.g., a planar wall), that by itself (receptacle contact), or through a beam extending from the body member (plug contact), defines an engagement portion for engaging a mating contact. A plurality of terminals extend from the body member for engagement with a printed circuit board. The board-to-board interface is completed when an electrical connector containing a receptacle contact is mated with an electrical connector containing a plug contact.

An example of a board-to-cable interface includes a first electrical connector employing a plug contact similar to that above, and a second electrical connector employing a receptacle contact having a plug projection extending from the body member instead of circuit board engaging terminals. The board-to-cable interface is completed when a power cable plug engages the plug projection on the receptacle contact and the mating first and second electrical connectors are engaged.

SUMMARY OF THE INVENTION

The present invention is directed to power contacts employed in electrical connectors that transmit electrical power. The preferred power contacts include multiple, electrical interface portions to provide for both a board-to-board interface and a cable-to-board interface. In accordance with one preferred contact embodiment, there has now been provided a power contact for an electrical connector, the power contact has a contact wall, at least one terminal extending from the contact wall, and at least one plug projection extending from the contact wall. A portion of the contact wall defines a first electrical interface for engaging a contact associated with a mating electrical connector. The terminal defines a second electrical interface for engaging a circuit board. And the plug projection defines a third electrical interface for engaging a cable plug connector.

In accordance with another preferred contact embodiment, there has now been provided a power contact for an electrical connector, the power contact has a first contact wall and a second contact wall. A portion of each of the first and second contact walls collectively define an electrical interface for engaging a contact associated with a mating electrical connector. At least one of the first contact wall and the second contact wall includes extensions that define electrical interfaces for engagement with multiple separate and independent electrical components in addition to the mating electrical connector.

In accordance with yet another preferred contact embodiment, there has now been provided a two-piece power contact for an electrical connector, the power contact has a first contact wall and a second contact wall that is uncoupled from the first contact wall. The first contact wall has a plug projection for engaging a cable plug, and a terminal for engaging a circuit board. A portion of each of the first and second contact walls collectively define an electrical interface for engaging a power contact associated with a mating electrical connector.

The present invention is also directed to electrical connectors employing power contacts. In accordance with one preferred connector embodiment, there has now been provided an electrical connector including an insulative housing and a power contact disposed in the insulative housing. The power contact includes a first electrical interface portion for engaging a contact associated with a mating electrical connector, a second electrical interface portion for engaging a circuit board, and a third electrical interface portion for engaging a cable plug connector.

In accordance with another preferred connector embodiment, there has now been provided an electrical connector having an insulative housing, a one-piece power contact, and a two-piece power contact. The one-piece power contact has a first contact wall and a second contact wall coupled to the first contact wall. The two-piece power contact has a first contact wall and a second contact wall spaced apart and uncoupled from the first contact wall.

In accordance with yet another preferred connector embodiment, there has now been provided an electrical connector including an insulative housing, a first power contact disposed in the insulative housing, and a second power contact disposed in the insulative housing. The first power contact includes a contact wall and at least one terminal extending from the wall for engaging a circuit board. The second power contact includes a contact wall, a plug projection extending from the wall for engaging an AC or DC cable plug or ground wire, and a terminal extending from the wall for engaging a circuit board.

These and various other features of novelty, and their respective advantages, are pointed out with particularity in the claims annexed hereto and forming a part hereof. However, for a better understanding of aspects of the invention, reference should be made to the drawings which form a further part hereof, and to the accompanying descriptive matter, in which there is illustrated preferred embodiments.

BRIEF DESCRIPTION OF THE DRAWINGS

The present invention is believed to be best understood through the following detailed description of the preferred embodiments and the accompanying drawings wherein like reference numerals indicate like features, and wherein.

DETAILED DESCRIPTION OF ILLUSTRATIVE EMBODIMENTS

Figure 1:
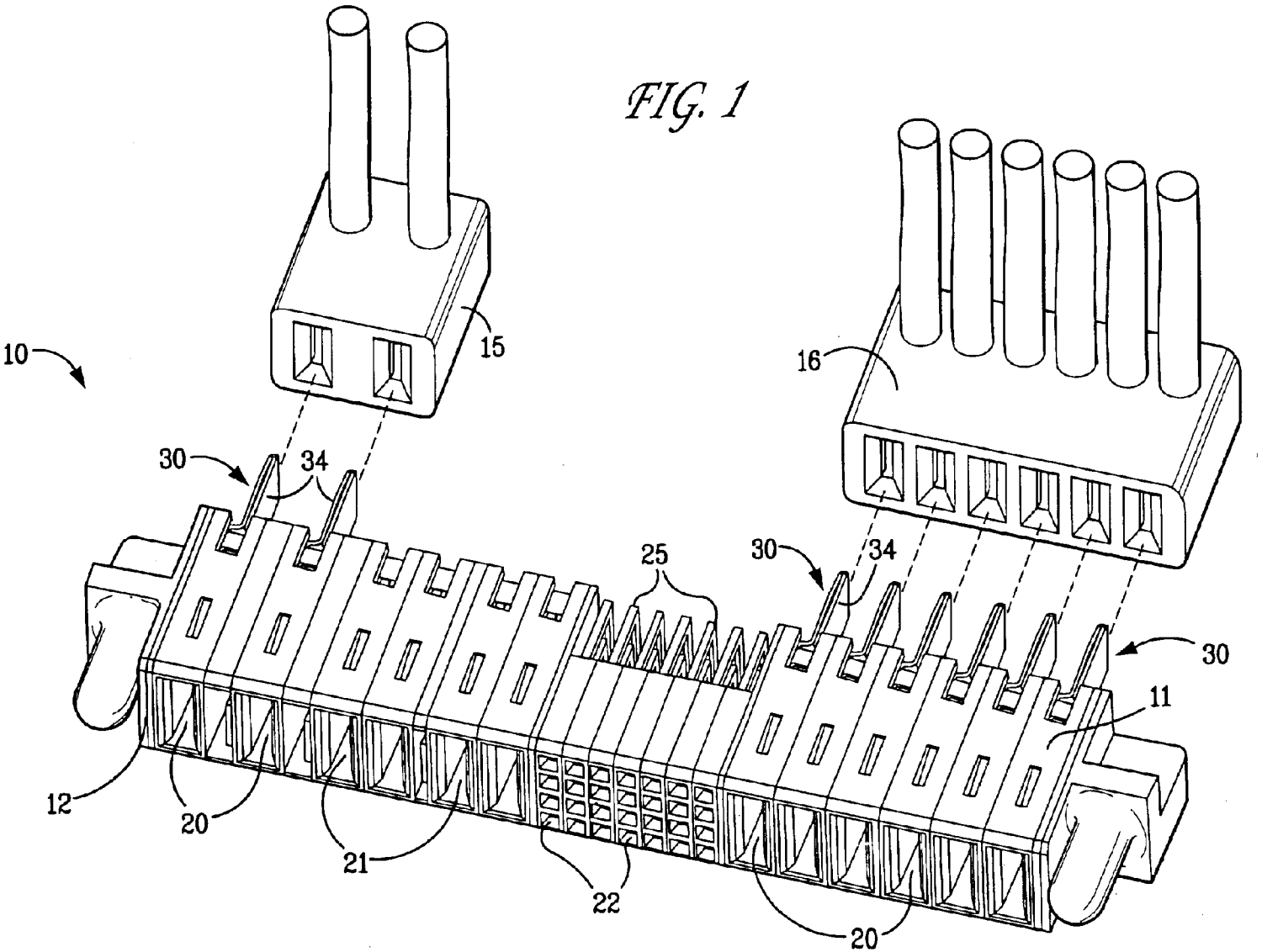
FIG. 1 is a perspective view of a first preferred electrical receptacle connector, including power contacts having plug projections extending from a rear portion of the insulative housing for engaging two separate plug connectors.

The present invention is believed to be best understood through the following detailed description of preferred embodiments and the accompanying drawings wherein like reference numbers indicate like features. Referring to FIG. 1, a preferred electrical power connector 10 is shown in the form of a receptacle connector. Electrical connector 10 includes an insulative housing 11 having a mating face 12 for engaging a complimentary electrical connector (header connector). Mating face 12 contains a plurality of apertures that provide access to electrical contacts disposed in insulative housing 11. For example, apertures 20 provide access to engaging portions of a first type of receptacle power contact 30 (shown in FIG. 2), apertures 21 provide access to engaging portions of a second type of receptacle power contact 60 (shown in Fig.), and apertures 22 provide access to signal contacts 25. The first type of receptacle power contacts 30 include at least one plug projection 34 for engaging a cable plug connector, such as, for example, connectors 15 and 16 included in FIG. 1.

Figure 2:
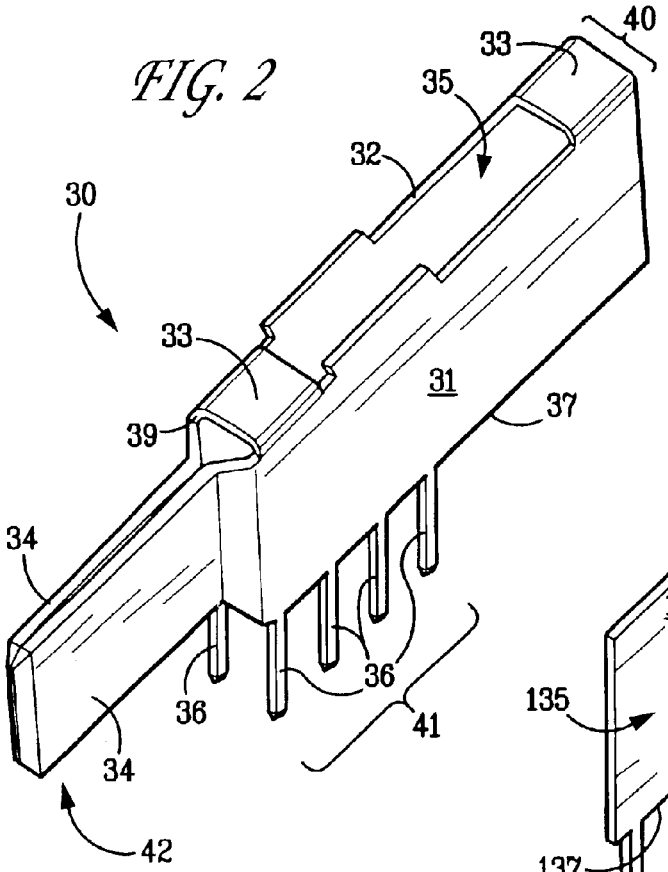
FIG. 2 is a perspective view of a first preferred power contact including portions for providing both a cable-to-board interface and a board-to-board interface.

Referring now to FIG. 2, an exemplary first type of power contact 30 is shown having opposed, preferably planar and parallel contact walls 31 and 32 connected by one or more bridging elements 33. Spaced apart contact walls 31 and 32 create a medial space 35 for receiving a plug contact associated with a mating electrical connector (see, e.g., header connector 100 shown in FIG. 5). Employing two contact walls can increase the electrical integrity of connectors employing the same. Furthermore, the two contact walls 31, 32 in conjunction with medial spaced 35, which allows for airflow between the contact walls, increases the ability (and rate) to dissipate heat generated by power transmission. Although all of power contacts 30 illustrated in the figures herein include two spaced apart contact walls, power contacts contemplated by the present invention and covered by one or more of the appended claims may include only a single contact wall, or two contact walls that are adjacent to each other such that a medial space (e.g., space 35) is not created. Similarly, power contacts 30 are shown having two spaced apart bridging elements 33, however, alternative embodiments may have a single bridging element extending along a substantial portion of an edge of the contact walls, or more than two bridging elements arranged on one or more edges of the contact walls.

Portions of contact walls 31 and 32 collectively define a first electrical interface 40 for engaging a contact associated with a mating electrical connector. Each of contact walls 31 and 32 have multiple terminals 36 extending from a bottom edge 37 for engaging a printed circuit board, thus defining a second electrical interface 41. As discussed above, plug projections 34 extend from a rear edge 39 of each of contact walls 31 and 32, which defines a third electrical interface 42 for engaging a cable plug connector. Thus, power contacts 30 are configured for engagement with three separate and independent electrical components: a mating connector, a cable plug connector, and a printed circuit board. Power contacts 30 provide both a cable-to-board interface via contact walls 31, 32 and plug projections 34, and a board-to-board interface via contact walls 31, 32 and terminals 36.

Figure 3:
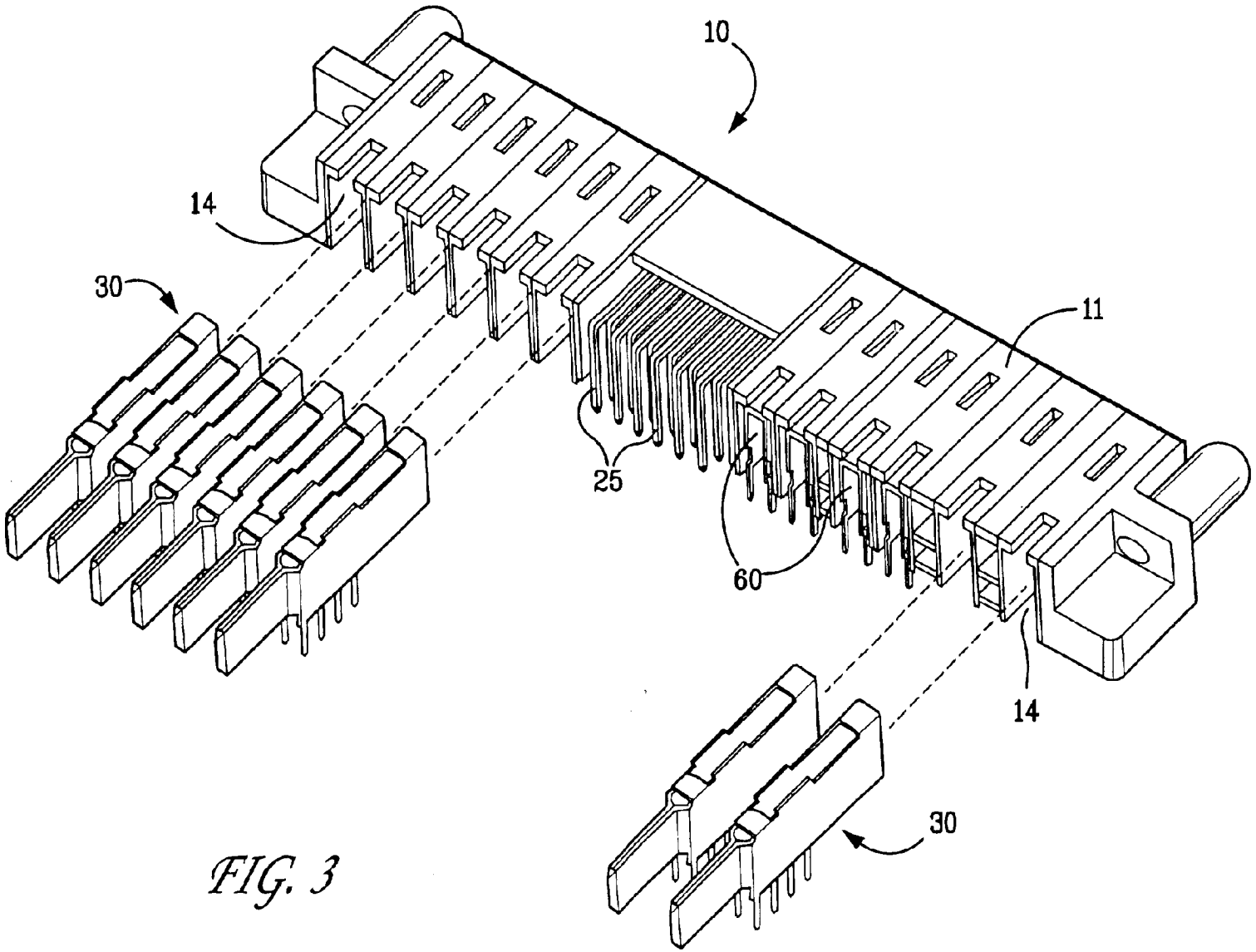
FIG. 3 is a rear perspective view of the preferred connector shown in FIG. 1, illustrating insulative housing silos for receiving individual power contacts.

With reference now to FIG. 3, a rear perspective view of electrical connector 10 is shown including silos 14 for housing individual power contacts 30. As mentioned above, electrical connector 10 houses additional contacts, including a second type of power contacts 60 and a plurality of signal contacts 25, both of which are shown already loaded into insulative housing 11. While power contacts 30 are configured to provide both a cable-to-board interface and a board-to-board interface, power contacts 60 are configured to provide only a board-to-board interface.

Figure 4:
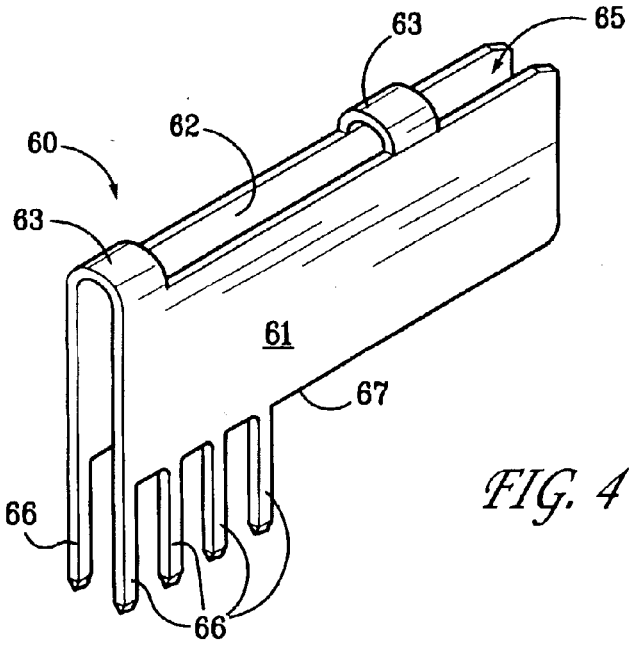
FIG. 4 is a perspective view of a second preferred power contact including portions for providing a board-to-board interface.

An exemplary power contact 60 is shown in FIG. 4, and includes two spaced apart contact walls 61 and 62 with a medial space 65 created therebetween. Contact walls 61 and 62 are coupled to each other by two bridging elements 63. Contacts associated with a mating electrical connector (not shown) engage a portion of each of contact walls 61 and 62. Terminals 66 extend from a bottom edge 67 of each of the contact walls for connection to a printed circuit board. One of ordinary skill in the art would readily appreciate that alternative electrical connectors may include less than all of the types of power and signal contacts illustrated in the figures. For example, alternative electrical connectors in accordance with the present invention may contain only power contacts (power contacts 30 and/or power contacts 60), or only one type of power contacts (power contacts 30 or 60) and a plurality of signal contacts.

Figure 5:
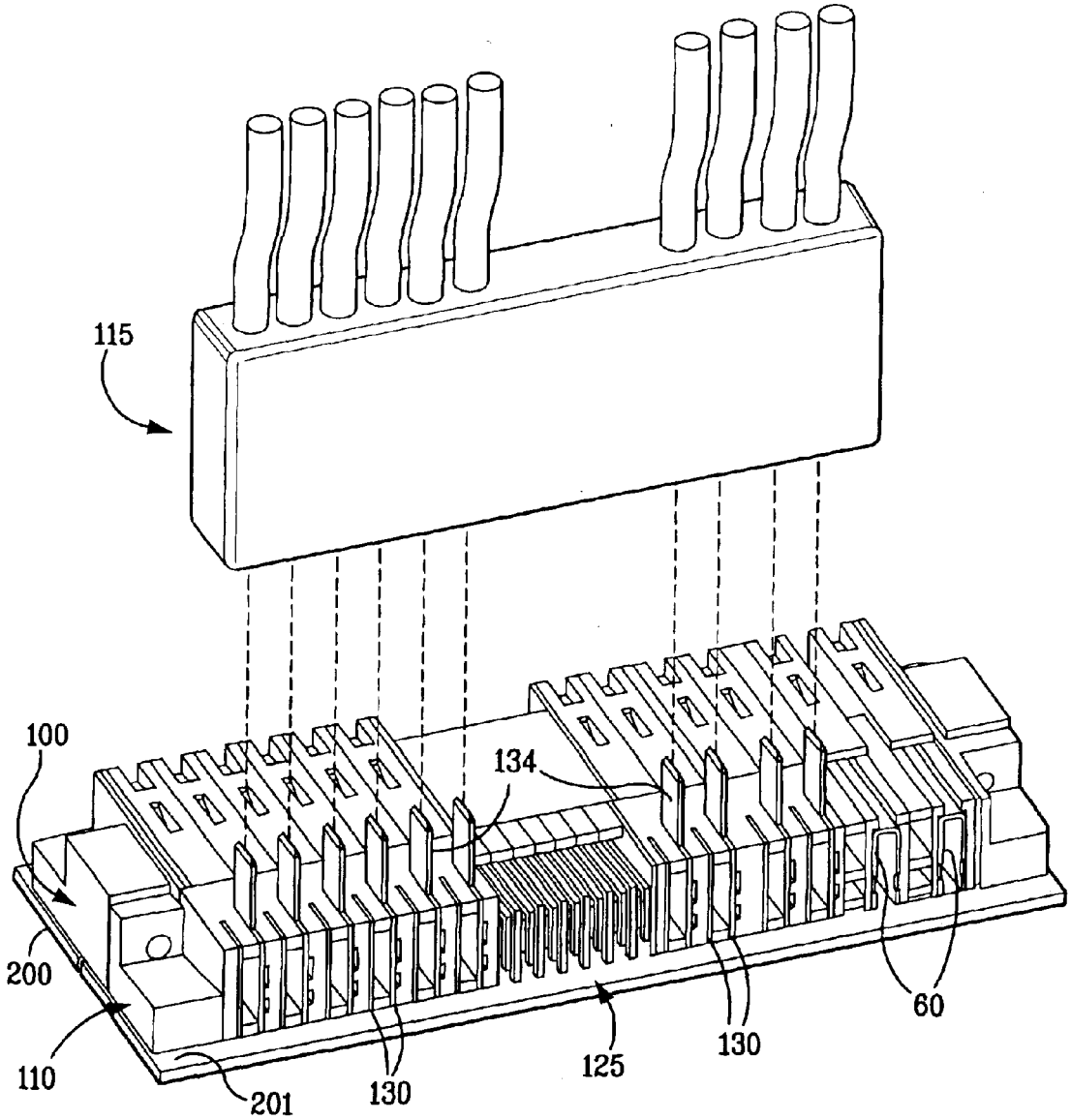
FIG. 5 is a perspective view of a second preferred electrical receptacle connector mated with a complimentary header connector, the second preferred electrical receptacle connector including a plurality of power contacts having plug projections extending from a top portion of the insulative housing for engaging a plug connector.

Another preferred electrical receptacle connector 110 is illustrated in FIG. 5 and is shown mated with a header connector 100. Electrical connector 110 includes an insulative housing 111 and is shown with a signal contact array 125, two power contacts 60 (see FIG. 4) and 10 power contacts 130. Each power contact 130 has a plug projection 134 that extends from a housing top portion 113 for engaging a cable plug connector 115. Mating connectors 100, 110 are shown connected to individual printed circuit boards 200 and 201, respectively.

Figure 6:
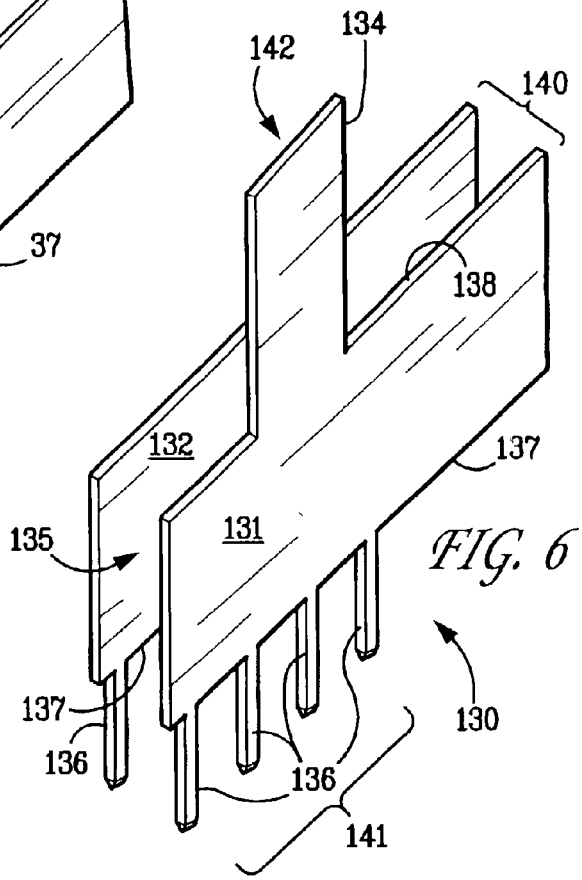
FIG. 6 is a perspective view of a preferred two-piece power contact including spaced apart contact walls, with one of the contact walls having a plug projection extending therefrom.

Referring now to FIG. 6, an exemplary power contact 130 is shown having two spaced apart contact walls 131 and 132, and a medial space 135. In contrast to the contact walls of power contact 30, contacts walls 131, 132 are uncoupled from one another (i.e., exemplary power contact 130 is a two-piece contact). Contact walls 131, 132 are individually inserted into connector housing 111 and their relative positioning is maintained by structure of the connector housing. A portion of each of contact walls 131, 132 collectively define an electrical interface 140 for engaging a contact in a mating electrical connector. Terminals 136 extend from bottom edges 137 of contact walls 131, 132 to define a second electrical interface 141 and for engaging a printed circuit board. The two spaced apart contact walls preferably terminate, via terminals 136, to a common power plane(s) in the printed circuit board. Contact wall 131 has a plug projection 134 extending from a top edge 138 to define a third electrical interface 142 and for engaging a cable plug connector. Contact wall 132 is shown devoid of a plug projection, but may alternatively also have a plug projection extending from its top edge.

Figure 7:
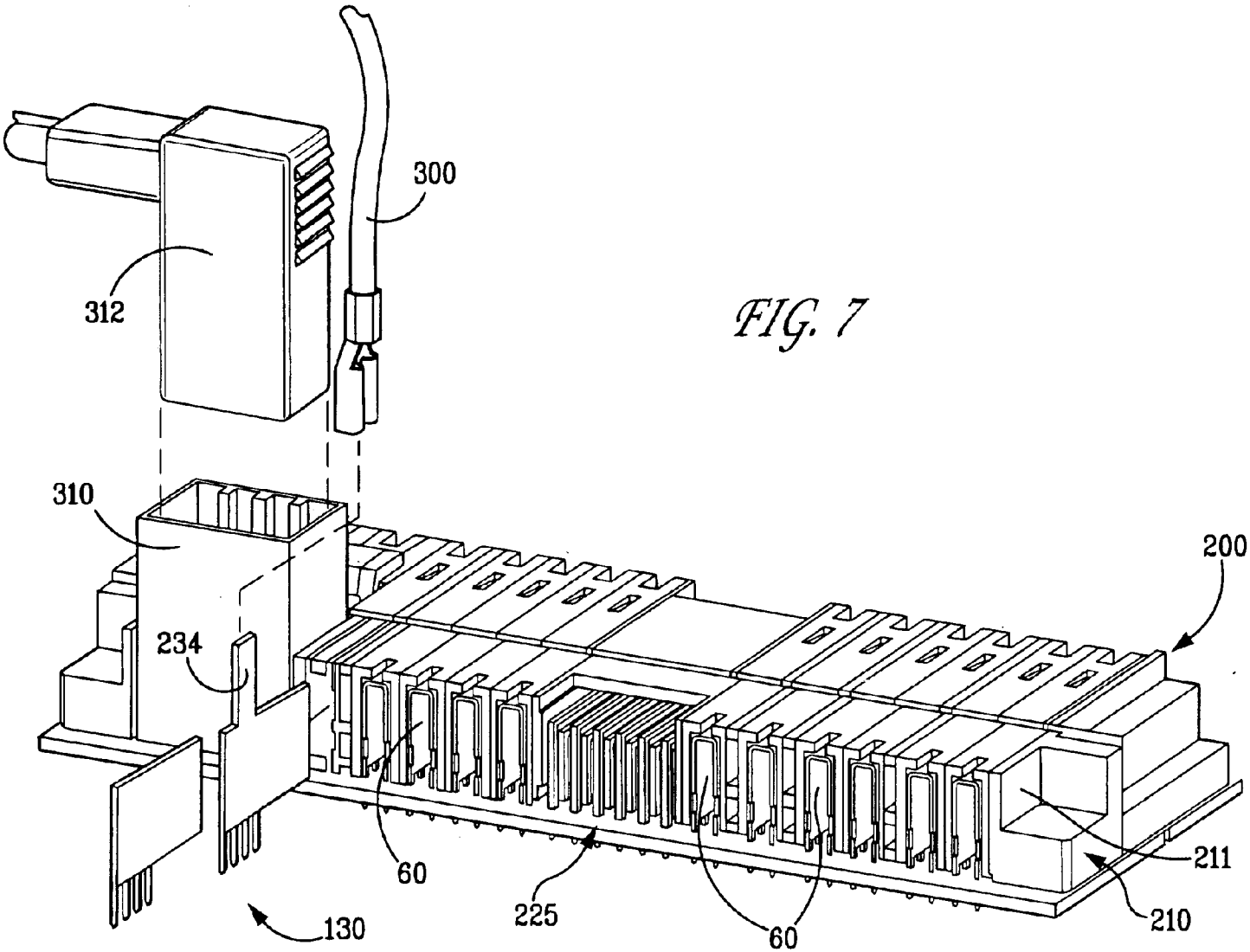
FIG. 7 is a third preferred electrical receptacle connector mated with a header connector, the receptacle connector including a power contact for engaging a ground wire, and a shrouded cable port for receiving an AC or DC cable plug.

Another preferred receptacle connector 210 is shown in FIG. 7, and is mated with a header connector 200. Receptacle connector 210 includes an insulative housing 211, an array of signal contacts 225, a plurality of power contacts 60, and a plurality of two-piece power contacts 130. One of the two-piece power contacts 130 includes a plug projection 134 for engaging a ground wire 300. The remaining power contacts are encompassed (and thus, not shown) by a shrouded cable port 310 that is configured for receiving an AC or DC cable plug 312. Connector 210 is shown with a vertically oriented cable port. However, alternative connectors include a shrouded cable port extending from a rear portion of its insulative housing.

Preferred power contacts are stamped or otherwise formed from suitable materials, such as, for example, phosphor bronze alloys, beryllium copper alloys, or high conductivity copper alloys. Signal contacts are preferably "pin-type" contacts that include tail portions for connection with a circuit board, and are made from suitable materials, such as, for example, copper alloys. The power and signal contacts may be plated with gold, or a combination of gold and nickel. Electrical connector housings are preferably molded or formed from a glass-filled high temperature nylon or other materials known to one having ordinary skill in the art.

The number and arrangement of the various preferred power contacts and signal contacts may differ from that which is shown in the figures. Furthermore, alternative electrical connectors contemplated by the present invention include only power contacts and do not include signal contacts. It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of features within the principles of the invention to the full extent indicated by the broad general meaning of the terms in which the appended claims are expressed.

What is claimed is:

1. A two-piece power contact for an electrical connector, the power contact comprising:

a first contact wall including a plug projection extending from the first contact wall for engaging a cable plug, and a terminal extending from the first contact wall for engaging a circuit board;

a second contact wall uncoupled from the first contact wall;

wherein a portion of the first contact wall and a portion of the second contact wall collectively define an electrical interface for engaging a power contact associated with a mating electrical connector.

2. The power contact of claim 1, wherein the second contact wall includes at least one terminal extending therefrom for engaging a circuit board.

3. The power contact of claim 2, wherein the second contact wall includes a plug projection extending therefrom.

4. An electrical connector comprising:

an insulative housing;

a power contact disposed in the insulative housing, the power contact including a first contact wall and a second contact wall coupled thereto; and a two-piece power contact disposed in the insulative housing, the two-piece power contact including a third contact wall, and a fourth contact wall spaced apart from the third contact wall and uncoupled from the third contact wall.

5. The electrical connector of claim 4, wherein each of the power contact and the two-piece power contact includes a terminal for engaging a circuit board.

6. The electrical connector of claim 4, wherein at least one of the third contact wall and the fourth contact wall of the two-piece power contact includes a plug projection extending therefrom for engaging a cable plug connector.

7. The electrical connector of claim 4, further comprising a signal contact disposed in the insulative housing.

8. An electrical connector comprising:

an insulative housing;

a first power contact disposed in the insulative housing, the first power contact providing both a cable-to-board electrical interface and a board-to-board electrical interface; and a second power contact disposed in the insulative housing, the second power contact providing a board-to-board electrical interface.

9. The electrical connector of claim 8, further comprising a signal contact disposed in the insulative housing.

10. A receptacle power contact comprising:

first and second planar contact walls;

a medial space defined between front portions of the first and second planar contact walls for receiving a plug power contact;

a plurality of terminals extending from each of the first and second planar contact walls for engaging a printed circuit structure; and a plug projection extending from a portion other than the front portion of at least one of the first and second planar contact walls for engaging a cable plug or ground wire.

11. The receptacle power contact of claim 10, wherein only one of the first and second planar contact walls includes a plug projection.

12. The receptacle power contact of claim 10, wherein both of the first and second planar contact walls includes a plug projection.

13. The receptacle power contact of claim 10, wherein the first and second planar contact walls are uncoupled.

14. The receptacle power contact of claim 10, wherein the first and second planar contact walls are coupled by a bridging element, and wherein each of the first and second planar contact walls includes a plug projection.

* * * * *